US005602291A

United States Patent [19]

Minkkinen et al.

[11] Patent Number: 5,602,291

[45] Date of Patent: Feb. 11, 1997

[54] PROCESS FOR ISOMERIZING $C_5/C_6$ NORMAL PARAFFINS WITH RECYCLING NORMAL PARAFFINS AND METHYL-PENTANES

[75] Inventors: Ari Minkkinen, Saint Nom la Breteche; Andre Deschamps, Noisy le Roi; Jean-Paul Cariou, Orgeval, all of France

[73] Assignee: Institut Francais du Petrole, France

[21] Appl. No.: 261,031

[22] Filed: Jun. 14, 1994

Related U.S. Application Data

[63] Continuation of Ser. No. 28,914, Mar. 8, 1993, abandoned.

[30] Foreign Application Priority Data

Mar. 6, 1992 [FR] France ..... 92 02812

[51] Int. Cl.[6] ..... C07C 5/12; C07C 7/12

[52] U.S. Cl. ..... 585/738; 585/826

[58] Field of Search ..... 585/738, 826

[56] References Cited

U.S. PATENT DOCUMENTS 2,958,644 11/1960 Kimberlin, Jr. et al. ..... 208/64

3,755,144 8/1973 Asselin ..... 208/95

5,043,525 8/1991 Haizmann et al. ..... 585/737

FOREIGN PATENT DOCUMENTS 876730 9/1961 United Kingdom .

*Primary Examiner*—Glenn A. Caldarola

*Attorney, Agent, or Firm*—Millen, White, Zelano, & Branigan, P.C.

[57] ABSTRACT

The invention involves a process for the isomerization of $C_5/C_6$ n-paraffins into isoparaffins comprising:

a stage (1) of isomerizing a charge constituted by a light naphtha and recycling a flow rich in methyl-pentanes and n-paraffins, an adsorption stage (2) performed by passing the isomerization effluent onto an adsorbent retaining the n-paraffins and alternating with the adsorpotion stage (2), a desorption stage (3) performed by lowering the pressure and stripping by means of a gas flow rich in methyl-pentanes from the deisohexanization stage (4) and a deisohexanization stage (4) for the adsorption effluent.

The isomerate freed from the n-paraffins in stage (2) and distilled in stage (4) is a high octane number product.

18 Claims, 2 Drawing Sheets

PROCESS FOR ISOMERIZING $C_5/C_6$ NORMAL PARAFFINS WITH RECYCLING NORMAL PARAFFINS AND METHYL-PENTANES

This application is a continuation of application Ser. No. 08/028,914, filed Mar. 8, 1993, abandoned.

BACKGROUND OF THE INVENTION

The invention relates to a process for the isomerization of n-paraffins into isoparaffins, normally with the aim of improving the octane number of certain petroleum fractions and more particularly those containing pentanes and n-hexanes, as well as pentanes and branched hexanes ($C_5/C_6$ fractions).

The existing processes for the isomerization of $C_5/C_6$ hydrocarbons using high activity chlorinated alumina-type platinum catalysts operate on a once through basis or with partial recycling after fractionation of the unconverted n-paraffins, or with a total recycling after passing onto liquid phase molecular sieve systems.

Once through operation, although simple, lacks effectiveness in increasing the octane number. To obtain high octane numbers, it is necessary to recycle low octane number constituents, after passing either into separating columns (e.g. a deisohexanizer) or onto molecular sieves in the liquid or vapor phase.

A known isomerization process using molecular sieves for vapor phase separation of unconverted n-paraffins integrates the adsorption stage using the molecular sieve with the reaction stage. This is the total isomerization process (TIP) e.g. described in U.S. Pat. No. 4,210,771. It combines the use of an isomerization reactor supplied by the mixture of the charge, a desorption effluent and hydrogen and the use of a separating section for the adsorption of the n-paraffins on the molecular sieve, desorption being carried out by hydrogen stripping. In such a process, the reaction system cannot consist of a high activity chlorinated alumina stage due to the risks of contamination by the hydrochloric acid of the integrated molecular sieves. Use is then made of a less high performance, zeolite-based catalytic system not using chlorine. This leads to a product having an octane number 1 to 2 points below that which would have been obtained with a chlorinated alumina-based catalyst. Thus, it is known in the art that the lower the isomerization temperature, the higher the conversion of n-paraffins into isoparaffins and in addition, the better the conversion of low octane number $C_6$ isomers (methyl-pentanes) into higher octane number $C_6$ isomers (dimethyl butanes).

It is also known that the platinum-impregnated chlorinated alumina-based catalyst makes it possible to carry out the isomerization reaction at a lower temperature than the more stable, unchlorinated zeolite-type catalysts.

It is therefore of particular interest to have a process able to combine a low temperature reaction system (in order to bring about the best once through octane number) and a recycling system for the low octane number constituents in the non-integrated or chlorine-resistant form.

Consideration can be given to conventional systems using separating columns (deisopentanizer and deisohexanizer), because the separating columns can be immunized against contamination by chlorine. However, they require a large amount of equipment and have a high energy consumption and are consequently expensive to use. A system using a single separating column (deisohexanizer only) would be less expensive, but would not be able to convert all the n-pentane into isopentane and could consequently not make it possible to obtain the octane number increase levels of systems using recycling.

To avoid contamination by chlorine of the molecular sieves used for the separation, consideration can be given to a non-integrated system using a stabilization stage for the isomerization effluent before supplying it to the adsorption stage. This has been proposed in the combined, so-called PENEX MOLEX process, in which the $C_5/C_6$ hydrocarbons are isomerized in a chlorinated alumina catalytic reaction, followed by adsorption on a molecular sieve in the liquid phase of the n-paraffins from the bottom of the stabilizer and at the bottom temperature. Use of a molecular sieve in adsorption and desorption in the liquid phase is more difficult to carry out than in the vapor phase. Thus, the relationship of the quantities of normal paraffins adsorbed to the quantities of isoparaffins present in the mobile phase is significantly in the favor of the vapor phase.

Another obstacle to the use of high activity catalytic systems is their sensitivity to the contaminants of the charge, namely sulphur and water. The liquid charge and the make-up hydrogen must be sweetened, freed from sulphur and dehydrated prior to introduction into the reaction system.

In the present state of the art using chlorinated alumina-based catalytic systems, the charges are dried in pretreatment operations by using several molecular sieves.

SUMMARY OF THE INVENTION

The object of the invention is to propose a novel process making it possible to increase to the greatest possible extent the octane number of a petroleum fraction containing normal paraffins, while limiting the energy costs.

The present invention makes it possible to obviate the disadvantages of the known processes by combining the high activity system e.g. using a catalyst consisting of platinum-impregnated chlorinated alumina and an original adsorption-desorption system on a molecular sieve in the vapor phase (non-integrated system). In addition, the desorption of n-paraffins is carried out under advantageous conditions from the energy standpoint by combining a pressure reduction and a stripping operation using a vapor rich in methyl-pentanes, which are also recycled and converted into dimethyl butanes during passage through the isomerization reactor.

In order to supply the methyl-pentane-rich vapor eluent for the desorption cycle, downstream of the system is incorporated a deisohexanizing column, which fractionates the effluent of the adsorption stage into two fractions, namely a distillate fraction only containing very high octane number isomers having a high dimethyl butane concentration and a column bottom fraction having a high methyl-pentane concentration with an octane number well below that of the distillate.

Moreover, the careful use of the methyl-pentanes supplied by the deisohexanization in the desorption stage makes it possible to eliminate a purging stage at the end thereof. Thus, the adsorbent column then filled with methyl-pentanes can be immediately reused in adsorption, the adsorption effluent not containing n-paraffins, even at the start of flow. This leads to a significant simplification of the unit more particularly making it possible to use a system only containing two adsorbent beds, each operating alternatively in adsorption and desorption.

According to another aspect of the invention, it is possible to use a system for recompressing the overhead vapors of the deisohexanizer (heat pump) to supply the reboiling energy of the deisohexanizer by the condensation of the reflux and the pure distillate thereof.

BRIEF DESCRIPTION OF THE DRAWINGS

The process according to the invention is described hereinafter relative to FIGS. 1, 2 and 3, wherein show.

DETAILED DESCRIPTION OF THE DRAWINGS

Figure 1:
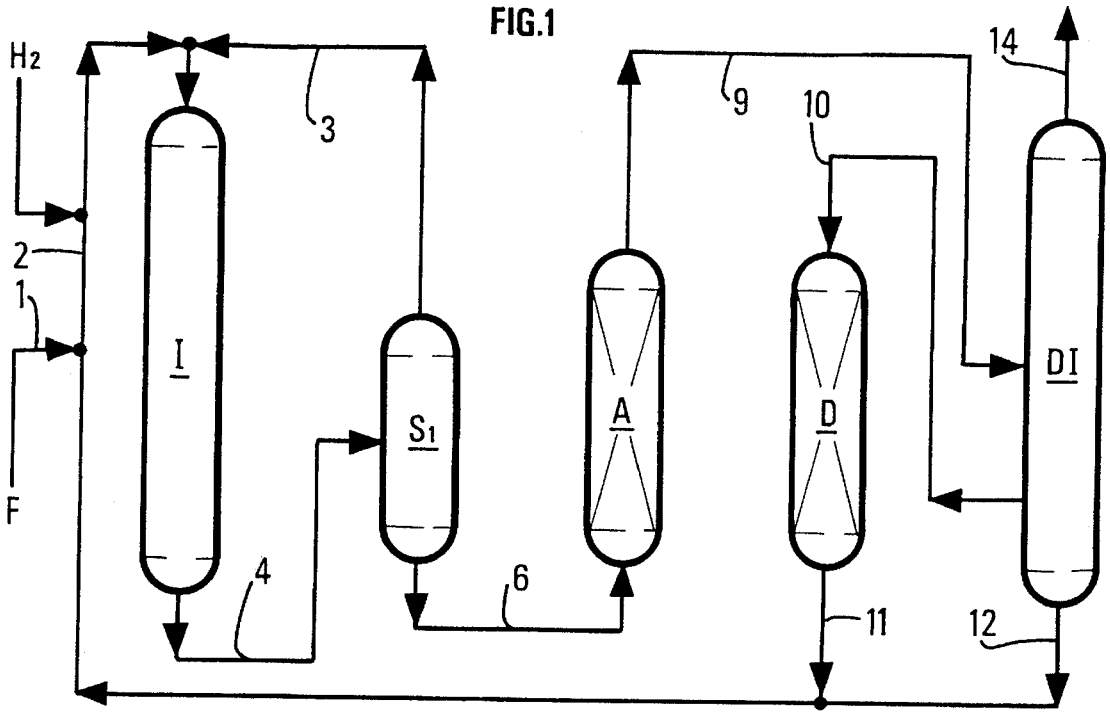
FIG. 1 a basic diagram.

A description will more particularly be given of the isomerization of a light naptha charge containing a preponderant proportion of $C_5$ and $C_6$ hydrocarbons into a high octane number isomerate.

The process according to the invention mainly comprises an isomerization stage (1), in which into an isomerization reactor is supplying a $C_5/C_6$ fraction representing the fresh charge, at least mixed with a recycling of a flow rich in n-paraffins and methyl-pentanes from the desorption stage (3), the effluent of said stage being fed into a separator, where separation takes place of a vapor phase, which is recycled to the intake of the reactor, and a liquid phase constituting the crude isomerate;

an adsorption stage (2) in which into an adsorber lined with a molecular sieve able to retain the n-paraffins and in rising flow manner, is supplied a vapor flow of the liquid effluent of the isomerization stage, after vaporization, and an isomerate free from n-paraffins is collected;

a desorption stage (3), alternating with stage (2), and in which the pressure in the adsorber is lowered and through the molecular sieve is passed a gaseous flow rich in methyl-pentanes from the deisohexanization stage (4), the effluent of said desorption stage being fed to the isomerization stage (1); and a deisohexanization stage (4), in which a distillation column is supplied by means of the effluent from the adsorpotion stage (2) and a liquid residue, a methyl-pentane-rich vapor flow and a distillate leading to the final isomerization product are obtained, the methyl-pentane-rich vapor flow being fed, as the desorbent, to the desorption stage (3).

In stage (I), into an isomerization zone 1 is supplied by means of the line 2 a light naphtha charge (line 1) mixed with at least one recycling of a flow rich in n-paraffins and methyl-pentanes from the desorption stage (3) (line 11) and optionally a recycling of part of the liquid residue of the deisohexanization stage (4) (line 12).

The isomerization reaction is performed at a temperature of 140° to 300° C. in the presence of hydrogen at a pressure of 10 to 40 bars. The charge to be treated is mixed with make-up hydrogen and optionally a hydrogen recycle from line 3 and is then e.g. heated to a temperature of 140° to 300° C. by means of a charge/effluent heat exchange in the exchanger E1 and a final heating in a furnace H.

The isomerization reaction is preferably performed on a high activity catalyst, e.g. a platinum and chlorinated alumina-based catalyst, operating at a low temperature of e.g. 130° to 220° C., a high pressure of e.g. 20 to 35 bars and a low hydrogen/hydrocarbon molar ratio e.g. between 0.1/1 and 1/1. Known catalysts which can be used are e.g. an alumina support $\gamma$ and $\eta$ of high purity containing 2 to 10% by weight chlorine, 0.1 to 0.35% by weight platinum and optionally other metals. They can be used with a space velocity of 0.5 to 10 $h^{-1}$ and preferably 1 to 4 $h^{-1}$. The maintenance of the degree of chlorination of the catalyst generally requires a continuous topping up of a chlorinated compound such as carbon tetrachloride injected mixed with the charge at a concentration of 50 to 600 parts per million by weight.

Obviously, it is also possible to use other known catalysts such as mordenite-type zeolite containing one or more metals, preferably from group VIII of the periodic classification of elements. A known catalyst is mordenite of ratio $SiO_2/Al_2O_3$ between 10 and 40, preferably between 15 and 25 and containing 0.2 to 0.4% by weight platinum. Nevertheless, within the scope of the process according to the invention, the catalysts belonging to this family are less interesting than those based on chlorinated alumina, because they operate at higher temperatures (240° to 300° C.) and lead to a less pronounced conversion of n-paraffins into high octane number isoparaffins.

Under these conditions, part of the n-paraffins is transformed into isoparaffins and part of the methyl-pentanes is transformed into dimethyl butanes. However, in the effluent passing out of the isomerization reactor by line 4, there is still a significant proportion of n-paraffins and methyl-pentanes and this can extend up to 50 mole % and is preferably between 25 and 50 mole %.

After cooling, the effluent of the isomerization stage (1) can pass into a separator S1, whose vapor is recycled by the line 3 to the intake of the isomerization reactor 1 and the liquid effluent (isomerate) passing out through the line 6 is vaporized and superheated in the exchanger E2 before being supplied by the line 8 to the adsorption stage (2). In the latter, the vapor mixture is passed in a rising flow into the adsorber A, which holds the n-paraffins. The isomerate freed from the n-paraffins passes out through the line 9 and can be at least partly condensed in the exchanger E3 before being supplied to the deisohexanization column.

The adsorbent bed is generally constituted by a molecular sieve based on a zeolite able to selectively adsorb the n-paraffins and having an apparent pore diameter close to 5 Å(=$5.10^{-8}$ cm). Zeolite 5 A is very suitable for this purpose, its pore diameter being close to 5 Å(=$5.10^{-8}$ cm) and it has a high n-paraffin adsorption capacity. However, it is possible to use other adsorbents such as chabazite or erionite. The preferred operating conditions are a temperature of 200° to 400° C. and a pressure of 10 to 40 bars. The adsorption cycle generally lasts 2 to 10 minutes. The effluent collected at the outlet from the adsorber A by the line 9 essentially only contains isoparaffins (isopentane and isohexane). It is condensed by heat exchange, e.g. by heat exchange with one of the reboilers E3 of the deisohexanization stage (4).

Figure 2:
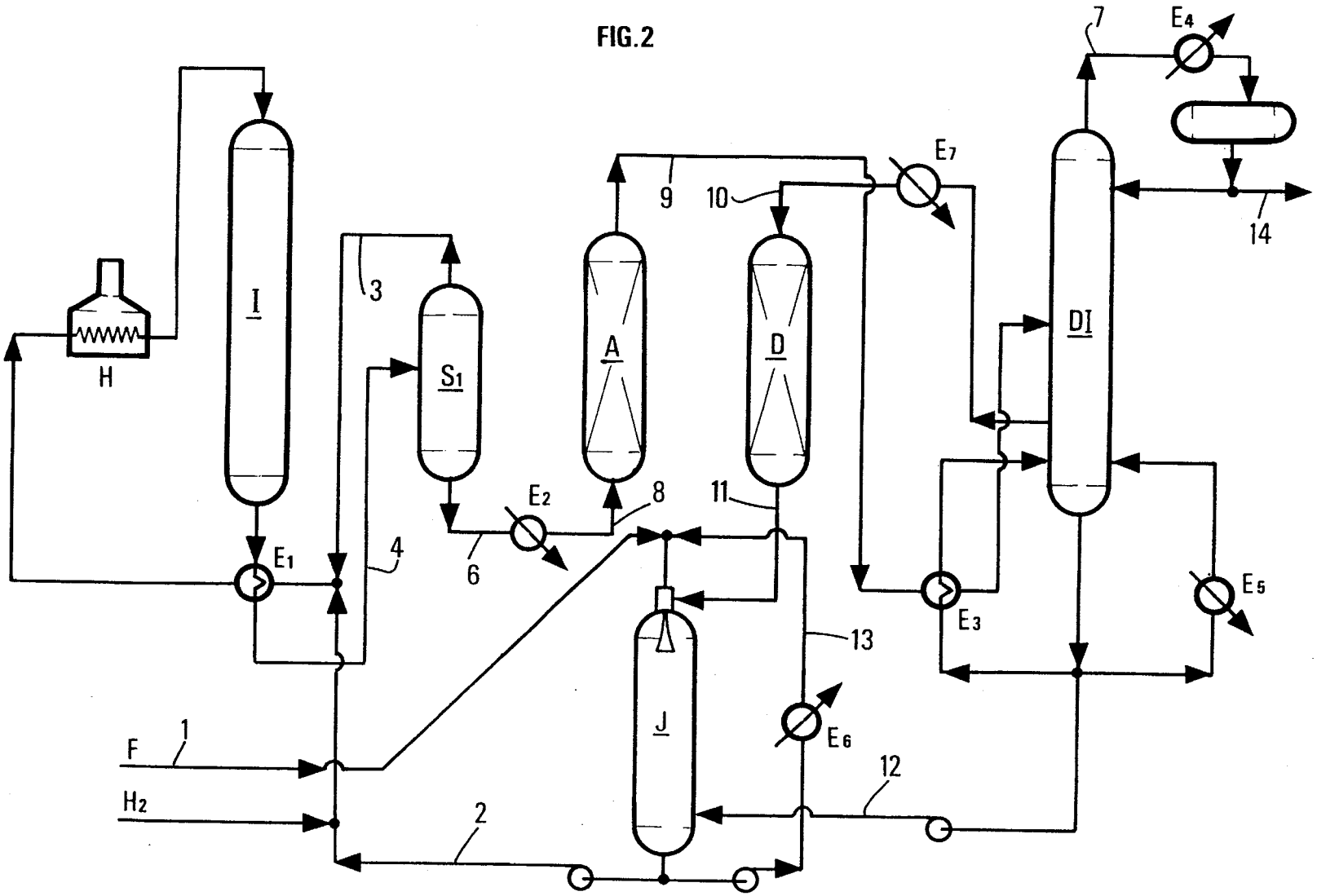
FIG. 2 a more detailed diagram of the process according to the invention.

The n-paraffins adsorbed during stage (2) are then desorbed in the desorption stage (3) shown in FIG. 2 by the adsorber D, which is the adsorber A saturated in n-paraffins and functioning in desorption. The operation is performed by lowering the pressure to below 5 bars, preferably below 3 bars and by a stripping by means of a methyl-pentane-rich gaseous flow drawn off at an appropriate level of the deisohexanization column and supplied by the line 10 through the adsorber D in a downward flow. This gaseous flow is generally heated to a temperature of 250° to 350° C. in the exchanger E7. The proportion of the methyl-pentanes in the rich flow necessary for the desorption advantageously corresponds to 0.5 to 2 moles of methyl-pentane-rich vapor per mole of n-paraffins to be desorbed. The operation generally lasts 2 to 10 minutes. The effluent of the desorption stage (3) is recycled to the isomerization stage by the line 11. It is directly condensed in the ejector J in contact with the fresh light naphtha charge arriving by the line 1 and with a liquid flowing in the line 13 and cooled by the exchanger E6. After desorption, the adsorber D is again used in adsorption. The effluent passing out of the adsorption stage is then supplied under the adsorption pressure to the deisohexanization stage (4). In stage (4) a deisohexanization column is supplied by the line 9 with the effluent from the adsorption stage (2), e.g. at a pressure of 1 to 2 bars absolute.

The deisohexanization column generally consists of a distillation column having internal fractionation means (structured packing or plates). The deisohexanization operation separates the charge into a dimethyl butane-rich distillate e.g. containing 20 to 40 mole % dimethyl butanes and a dimethyl butane-depleted residue e.g. containing 5 to 10 mole % dimethyl butanes.

Before being introduced into the deisohexanization column, the charge can be condensed and cooled, e.g. to 100° to 120° C., optionally by heat exchange with one of the reboilers of the deisohexanization column in the exchanger E3. The deisohexanization column generally operates at between a bottom temperature of 80° to 100° C. and a head temperature of 20° to 60° C.

The hot residue from the deisohexanization column passing out through the line 12 is then recycled and supplied to the isomerization reactor following mixing with the fresh charge (line 1) and the desorption effluent (line 11) in the ejector/mixer J. A lateral drawing off makes it possible to remove a methyl pentane-rich vapor flow supplied by the line 10 to the adsorber D carrying out desorption.

The overhead vapors (distillates) passing out through the line 7 are generally condensed by a heat exchanger with the cooling water in a condenser E4. The condensate is partly recycled at the top of the deisohexanizer (reflux) and partly supplied by pumping through the line 14 as the main isomerization produce or isomerate.

In one of the preferred operational versions, the overhead vapors (distillates) passing out through the line 7 can be compressed in a compressor (heat pump) to an adequate pressure of 5 to 6 bars, so that they condense at a temperature 10° to 25° higher than that required for column bottom reboiling. The condensation of the vapors can then be used for supplying the energy required by the reboiler by means of the exchanger E5 and while obviating any need for an external energy supply. Condensation largely takes place in this way, which makes it possible to economize on the cooling means necessary for the total condensation of the reflux and the distillate.

According to another preferred variant of the process, particularly when using a chlorinated alumina-based catalyst, between the isomerization stage (1) and the adsorption stage (2) there is a stage of stabilizing the isomerization effluent aimed mainly at eliminating the hydrochloric acid from the catalyst, as well as the hydrogen and light $C_1$ to $C_4$ hydrocarbons.

After cooling, e.g. by heat exchange with the charge supplying the said reactor in the exchanger E1, the isomerization reactor effluent consisting of a two-phase mixture is supplied by the line 4 directly to the stabilization column S2 generally operating at a pressure of 10 to 20 bars, advantageously approximately 15 bars. The stabilizer S2 is shown diagrammatically in FIG. 3. At the head the stabilizer eliminates the lightest products and any hydrogen excess and which pass out through the line 15. The distillate is partly condensed by water cooling in the exchanger E8, the condensate obtained being at least partly recyclable to the stabilizer head by means of the line 16. If desired, it is also possible to collect a LPG as the pure distillate using line 17.

The hydrochloric acid which may be present (when the isomerization catalyst is based on platinum-impregnated chlorinated alumina) is sufficiently volatile to pass totally into the stabilizer head and is discharged with the gaseous products by the line 15. The stabilizer bottom product, which is free from hydrochloric acid, is drawn off by the line 6 in the form of a vapor flow at the stabilizer pressure and is fed to the adsorber following a complementary heating in the exchanger E2. The stabilizer reboiler is thus used for vaporizing the charge of the adsorber A at a temperature of approximately 150° to 200° C., permitting the vapor phase supply of the latter.

On the basis of light naphthas rich in $C_5/C_6$ and having a research octane number (RON) of 65 to 75, the process according to the invention makes it possible to obtain an isomerate having a RON of 89 to 92.

The following, non-limitative example illustrates the invention.

EXAMPLE

Figure 3:
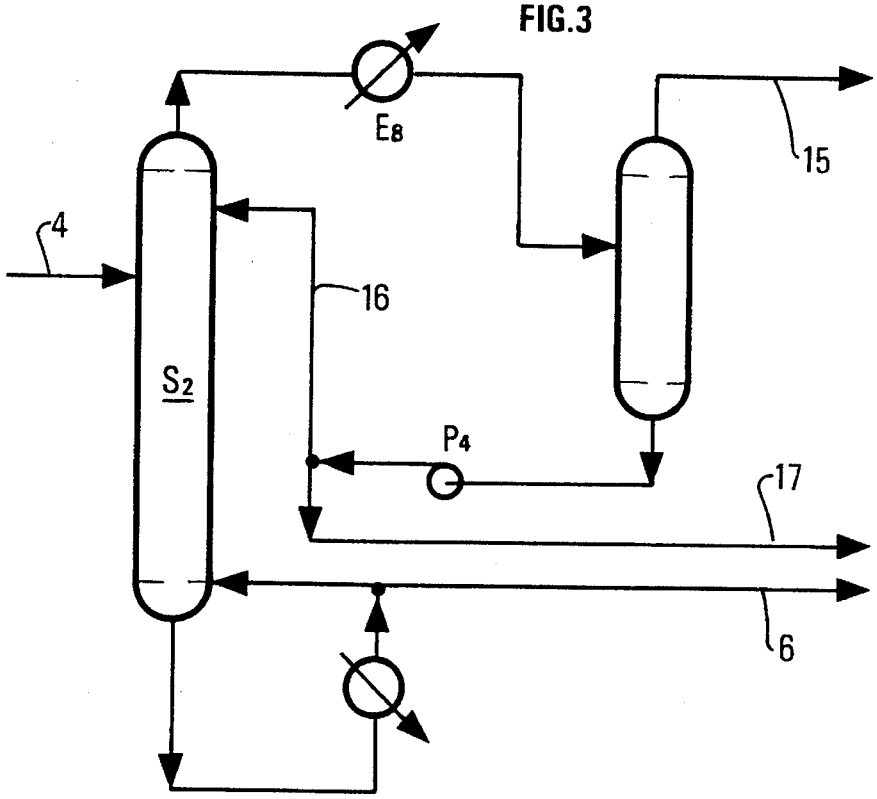
FIG. 3 diagrammatically a stabilization stage.

The process according to the invention is performed in a pilot installation corresponding to the diagram of FIG. 2 and modified according to the diagram of FIG. 3. Therefore the separator S1 is replaced by the stabilization column S2 and does not recycle hydrogen to the isomerization reactor 1. The charge F is constituted by a light naphtha which has previously been desulfurized and dried and having the following molar composition:

| Constituent | Mole % |
|---|---|
| Isobutane ($iC_4$) | 0.4 |
| n-butane ($nC_4$) | 2.4 |
| isopentane ($iC_5$) | 21 |
| n-pentene ($nC_5$) | 29 |
| Cyclopentane (CP) | 2.2 |
| 2,2-dimethylbutane (22 DMB) | 0.5 |
| 2,3-dimethylbutane (23 DMB) | 0.9 |
| 2-methylpentane (2 MP) | 12.7 |
| 3-methylpentane (3 MP) | 10 |
| n-hexane ($nC_6$) | 14 |
| Methylcyclopentane (MCP) | 5 |
| Cyclohexane (CH) | 0.5 |
| Benzene | 1.3 |
| $C_{7+}$ | 0.1 |

Its sulfur content is 0.5 ppm by weight, its water content 1 ppm by weight and its RON 70.2.

The liquid charge is introduced by the line 1 into an ejector/mixer J at a flow rate of 77.6 kg/h. Simultaneously, suction takes place into said ejector/mixer at an average rate of 44 kg/h of a recycling flow from the desorption zone D and using the line 11. The ejector/mixer operates under a pressure of 2 bars and the fresh, recycled liquid charge introduced as motor fluid is preheated to a temperature of approximately 80° C. by direct contact with the vapor from the desorption. The vapor is completely condensed and cooled to the same temperature. Simultaneously injection also takes place into said mixer at an average flow rate of 25 kg/h of a recycling flow from the bottom of the distillation column D1 using line 12.

The bottom liquid of said mixer, taken up by a pump, is supplied by the line 2 to the isomerization reactor I following hydrogen make-up and preheating to a temperature of 140° C. under a pressure of 30 bars. The reactor contains 62 liters of alumina-based isomerization catalyst η containing 7% by weight chlorine and 0.23% by weight platinum. To maintain the activity of the catalyst, there is a continuous make-up of 42 g/hour of carbon tetrachloride in the charge, which corresponds to a content of 500 ppm by weight. The isomerization reaction is performed under an average pressure of 30 bars and a temperature of 140° C. (intake) to 160° C. (outlet). Under these conditions, the hydrocarbon effluent of the isomerization reactor contains approximately 8 mole % $nC_5$, 5.5 mole % $nC_6$ and approximately 26 mole % methyl-pentanes.

The complete effluent of the isomerization reactor is supplied directly by the line 4 to the stabilization column S2 (FIG. 3) operating under a pressure of 15.5 bars and at a temperature of approximately 200° C. to the reboiler and at a temperature of 30° C. to the reflux flask. Head purging takes place using the line 15 of a gaseous mixture essentially containing hydrogen. The bottom fraction containing less than 0.5 ppm by weight HCl is drawn off in the vapor phase at the reboiler by the line 6 and is preheated to 300° C. and introduced in vapor phase form at the bottom of the adsorber A by the line 8. The latter functions under an average pressure of 15 bars and an average temperature of 300° C. during the adsorption phase, which lasts approximately 6 minutes. The internal diameter 16 cm and height 4 m adsorber contains 40 kg of zeolite 5A in the form of 1.6 mm diameter extrudates. At the adsorber outlet line 9 recovers at a flow rate of approximately 123 kg/h an isomerate containing less than 1 mole % $C_5/C_6$ n-paraffins and having a RON of 88 to 88.5, which is then supplied under pressure to the reboiler E3 of the distillation column D1.

Simultaneously the adsorbent bed contained in the adsorber D and having the same dimensions as that of the adsorber and which was used in a preceding adsorption phase, is now in the desorption phase. The latter is carried out by lowering the pressure from 15 to 2 bars and injecting at the top of the reactor at 300° C. and with an average flow rate of 20 kg/h, vapor drawn off from the column DI and which is rich in methyl-pentanes (line 10). The adsorbent bed temperature is close to 300° C. throughout the desorption phase, which lasts 6 minutes. The desorption effluent drawn off at the bottom of the adsorber D contains approximately 29 mole % $nC_5$ and 21 mole % $nC_6$ and is recycled by the line 11 to the ejector/mixer J. At the end of each 6 minute period, the adsorbers A and D are switched by means of a set of valves, so as to operate alternately in the desorption and adsorption phase.

The effluent of the adsorber A (line 9), totally condensed in the distillation column reboiler E3 is expanded in a pressure control valve and the expanded mixture is introduced into the distillation column DI. The structured packed column having an efficiency of approximately 40 theoretical stages operates under a pressure of 2 bars with a reflux ratio of 4, based on the pure distillate. The column head vapor is condensed with the cooling water and the condensate is collected in the reflux flask, from which is drawn off by line 14 76 kg/h of distillate, which constitutes the end product.

The process was continuously performed for 34 days under the conditions described hereinbefore supplying an isomerate with a research octane number (RON) between 89.5 and 91.7.

We claim:

1. A process for the isomerization of n-paraffins into paraffins in a charge consisting essentially of a $C_5/C_6$ fraction, comprising:

passing a fresh charge consisting essentially of a $C_5/C_6$ fraction into an isomerization reactor in an isomerization stage, said charge being mixed with a recycle flow containing a major proportion of n-paraffins and methyl-pentanes from a desorption stage;

isomerizing the charge in said isomerization stage;

feeding the effluent from said isomerization stage into a separator;

separating said effluent into a vapor phase and a liquid effluent phase containing $C_5/C_6$ which constitutes crude isomerate;

recycling said vapor phase to said isomerization stage;

vaporizing said liquid effluent phase containing $C_5/C_6$ to form a vapor flow;

passing said vapor flow upwardly through a first adsorber filled with a molecular sieve in an adsorption stage to retain n-paraffins from the vapor flow;

collecting as a vapor head effluent an isomerate free of n-paraffins from said adsorption stage;

passing, in a desorption stage, a gaseous flow containing a major proportion of methyl-pentanes and deficient in n-paraffins from a deisohexanization stage downwardly through a second adsorber and lowering the pressure of said second adsorber whereby the gaseous flow strips adsorbed n-paraffins from the molecular sieve in said second absorber;

alternating said desorption stage with said adsorption stage;

recycling effluent from said desorption stage to said isomerization stage as said recycle flow; and passing said vapor head effluent from said adsorption stage to a distillation column in said deisohexanization stage to produce a liquid residue, an isomerate and said gaseous flow containing a major proportion of methyl pentanes which is fed, as a desorbent, to said desorption stage.

2. A process according to claim 1, wherein the $C_5/C_6$ fraction is a light naphtha.

3. A process according to claim 1, wherein said deisohexanization stage is maintained at a pressure of 1 to 2 bars, a bottom temperature of 80° to 100° C. and a head temperature of 20° to 60° C., so that said isomerate contains 5 to 10 mole % dimethyl pentanes and said residue contains 5 to 10 mole % dimethyl butanes.

4. A process according to claim 1, wherein said isomerate from said deisohexanization stage is compressed to a pressure of 5 to 6 bars, such compression causing condensation thereby supplying the heat necessary for reboiling said distillation column of said deisohexanization stage.

5. A process according to claim 1, wherein in said isomerization stage, said fresh charge is mixed with said recycle flow of methyl-pentanes and n-paraffins in the presence of hydrogen and is passed onto a catalyst consisting essentially of a zeolite containing at least one group VIII metal or a platinum-impregnated chlorinated alumina, under a pressure of 10 to 40 bars and a temperature of 140° to 300° C.

6. A process according to claim 1, wherein said adsorption stage is performed at a temperature of 200° to 400° C. and a pressure of 10 to 40 bars, for a time of 8 to 10 minutes.

7. A process according to claim 1, wherein in said desorption stage, the pressure is lowered to below 5 bars, and the methyl-pentane-rich gaseous flow taken from said deisohexanization stage is heated to 250° to 350° C. is passed to said desorption stage in a proportion corresponding to 0.5 to 2 moles of vapor per mole of n-paraffins being desorbed for a time of 2 to 10 minutes.

8. A process according to claim 1, wherein part of said liquid residue of said deisohexanization stage is recycled to said isomerization stage.

9. A process according to claim 1, wherein said effluent of said isomerization stage is fed in a stabilization stage into a stabilization column at a pressure of 10 to 20 bars, producing a head effluent and a bottom effluent, the head effluent being light products, and the bottom effluent being supplied to the adsorption stage.

10. An isomerate having a RON of 89 to 92 obtained by a process according to claim 1.

11. An isomerate having a RON of 89 to 92 obtained by a process according to claim 2.

12. An isomerate having a RON of 89 to 92 obtained by a process according to claim 3.

13. An isomerate having a RON of 89 to 92 obtained by a process according to claim 4.

14. An isomerate having a RON of 89 to 92 obtained by a process according to claim 5.

15. An isomerate having a RON of 89 to 92 obtained by a process according to claim 6.

16. An isomerate having a RON of 89 to 92 obtained by a process according to claim 7.

17. An isomerate having a RON of 89 to 92 obtained by a process according to claim 8.

18. An isomerate having a RON of 89 to 92 obtained by a process according to claim 9.

* * * * *